US008419450B2

(12) United States Patent
Schmiedle et al.

(10) Patent No.: US 8,419,450 B2
(45) Date of Patent: Apr. 16, 2013

(54) CONDUCTOR LINE, COLLECTOR AND CONDUCTOR SYSTEM

(75) Inventors: Andreas Schmiedle, Lörrach (DE); Matthias Wenk, Efringen-Kirchen (DE); Frank Schirmeier, Schopfheim (DE)

(73) Assignee: Conductix-Wampfler GmbH, Weil Am Rhein-Markt (DE)

( * ) Notice: Subject to any disclaimer, the term of this patent is extended or adjusted under 35 U.S.C. 154(b) by 97 days.

(21) Appl. No.: 13/061,990

(22) PCT Filed: Sep. 1, 2009

(86) PCT No.: PCT/EP2009/061278

§ 371 (c)(1), (2), (4) Date: May 10, 2011

(87) PCT Pub. No.: WO2010/026137

PCT Pub. Date: Mar. 11, 2010

(65) Prior Publication Data

US 2011/0300723 A1 Dec. 8, 2011

(30) Foreign Application Priority Data

Sep. 3, 2008 (DE) ..... 10 2008 045 482

(51) Int. Cl.
*H01R 13/64* (2006.01)

(52) U.S. Cl.
USPC ..... 439/110; 439/677

(58) Field of Classification Search ..... 439/110–120, 439/677
See application file for complete search history.

(56) References Cited

U.S. PATENT DOCUMENTS 3,900,240 A 8/1975 Bertrams et al.
(Continued)

FOREIGN PATENT DOCUMENTS

DE 19519644 A1 12/1995
(Continued)

OTHER PUBLICATIONS

International Search Report published Mar. 11, 2010 for PCT/EP2009/061278 filed Sep. 1, 2009.
(Continued)

*Primary Examiner* — Gary F. Paumen
(74) *Attorney, Agent, or Firm* — Martin Fleit; Paul D. Bianco; Fleit Gibbons Gutman Bongini & Bianco PL

(57) ABSTRACT

The invention relates to: a conductor line (2) for powering at least one device (11) that can travel along the conductor line (2), comprising a first elongated conductor lane (5*b*) and at least one other, second elongated conductor lane (6*b*), wherein the first (5*b*) and second (6*b*) conductor lanes comprise a first (5*f*) and a second (60*f*) contact opening, respectively, running along the length of the respective lane, for holding a part (15*a;* 16*a*) of a first (15) and a second (16) respective conductor contact of a collector (14) of the device (11); a collector (3) comprising at least one first conductor contact (15) provided for engaging into a first contact opening (5*f*) running along the length of a first conductor lane (5*b*) of the conductor line (2) and for electrically connecting to the first conductor lane (5*b*); and a conductor line system (1) formed therefrom. The invention accomplishes the objective of enabling a simple, fast, but non-mistakable connection of a specific conductor contact to a specific conductor lane of a conductor line, using a conductor line (2), a collector (14) and a conductor line system (1), wherein the second contact opening (6*f*) of the second conductor lane (6*b*) is adapted so that the first conductor contact (15) provided for connecting to the first conductor lane (5*b*) cannot engage into the second contact opening (6*f*) and cannot be connected to the second conductor lane (9).

20 Claims, 4 Drawing Sheets

U.S. PATENT DOCUMENTS

| | | | | |
|---|---|---|---|---|
| 5,336,097 | A * | 8/1994 | Williamson et al. | 439/94 |
| 6,976,885 | B2 | 12/2005 | Lord | |
| 2005/0197018 | A1 | 9/2005 | Lord | |
| 2006/0094302 | A1 | 5/2006 | Lord | |
| 2010/0273361 | A1 | 10/2010 | Lord | |

FOREIGN PATENT DOCUMENTS

| | | | |
|---|---|---|---|
| DE | 19647336 | A1 | 5/1998 |
| DE | 19755513 | A1 | 6/1999 |
| DE | 10219452 | A1 | 2/2004 |
| DE | 2358895 | A1 | 1/2008 |
| DE | 602004006116 | T2 | 1/2008 |
| FR | 2578109 | A1 | 8/1986 |
| JP | 8072593 | A | 3/1996 |

OTHER PUBLICATIONS

International Preliminary Report on Patentability published Mar. 8, 2011 for PCT/EP2009/061278 filed Sep. 1, 2009.

Written Opinion published Mar. 3, 2011 for PCT/EP2009/061278 filed Sep. 1, 2009.

* cited by examiner

CONDUCTOR LINE, COLLECTOR AND CONDUCTOR SYSTEM

FIELD OF THE INVENTION

The invention pertains to a conductor line, a collector and a conductor-line system.

BACKGROUND OF THE INVENTION

In known conductor-line systems, movable devices such as, e.g., cable trolleys or transport gears of an electric telpherage system with or without electric loads, travel along a conductor line. In order to supply the device with electric energy, said device is provided with a collector, the sliding contacts of which engage into conductor lanes extending along the conductor line. The devices may consist, e.g., of transport gears or cable trolleys that move along rails, wherein said devices are equipped with an electric drive that is supplied with electric energy via the conductor line. Several transport gears may also be coupled to one another, in which case only the front transport gear is frequently equipped with an electric drive. The other transport gears, in contrast, merely serve as load carriers and do not feature a drive or other electric loads.

One example of a known conductor-line system of this type is disclosed in DE 196 47 336 A1. In this case, a collector trolley is provided that moves along an installation section on an independent running rail, wherein sliding contacts engage into conductor lanes of the conductor line that are realized in the form of current rails.

In order to protect the operating personnel and other devices, the transport gears or their usually metallic housing and other parts that should not conduct a current are grounded. For this purpose, a protective sliding contact is provided that engages into a neutral and grounded protective-conductor lane of the conductor line that is realized in the form of a protective conductor. The other conductor lanes are phase conductors that are energized in the normal operating mode and deliver a current to the electric loads. Trailing transport gears without electric loads are usually also connected to the protective-conductor lane via a protective sliding contact. In case of a fault, in which parts or the housing of the transport gear are energized, this ensures that the phase conductor voltage is switched off as quickly as possible, for example by means of a fault current detection, before a person or other system components are energized.

The sliding contacts of the collectors are frequently designed for clicking or clipping into the conductor lanes in order to transfer the sliding contacts from an idle, non-contacting position into a contacting position on the conductor lane. This is usually realized manually by means of an operator. Due to the frequently poor accessibility to the sliding contacts or the inattention and carelessness of the operator, it may occur that a sliding contact is not clipped into the intended conductor lane, but rather into a phase-conductor lane situated adjacent thereto. This is particularly dangerous if the protective sliding contact is not clipped into the protective-conductor lane, but rather into one of the phase-conductor lanes such that all parts of the transport gear that are not intended for conducting a current and normally grounded and therefore not energized by means of the protective-conductor lane or the housing of the transport gear are energized or become energized when the phase conductor voltage is switched on. This represents a significant risk for the operating personnel and system components, particularly if no fault detection is provided that detects such a fault and sounds an alarm. For example, an operator contacting the energized components may receive a possibly fatal electric shock.

This risk is particularly high when clipping in the protective sliding contact of trailing trolleys without electric loads because they do not feature additional sliding contacts for the phase-conductor lanes. If the protective sliding contact is accidentally clipped into a phase-conductor lane in this case, the trailing trolleys or their housing is energized with the operating voltage. If the correct connection between the protective sliding contact and the protective-conductor lane is not checked again, the potential risk is particularly high because such an error is frequently not detected at all over extended periods of time or until an accident occurs.

In order to lower this risk, JP 08 072 593 A proposes to provide colored marking to the lateral lines of the ground conductor in a conductor line with three conductors for the electric energy supply and one ground conductor. This solution, in principle, improves the protection against clipping a ground-conductor collector contact into an energy-supply conductor because the operating personnel is able to better distinguish the ground conductor from the energy-supply conductors. However, it is still possible to erroneously connect the ground-conductor collector contact to one of the energy-supply conductors in this case such that the risk of an operating error can never be reliably precluded.

SUMMARY OF THE INVENTION

The invention therefore is based on the objective of making available a conductor line, a collector and a conductor-line system that eliminate the above-described disadvantages and make it possible to produce a simple, fast, yet foolproof connection of a certain sliding contact with a certain conductor lane of a conductor line.

According to the invention, this objective is attained with at least one embodiment of the conductor line, a collector, and a conductor-line system as disclosed herein. Advantageous refinements and other embodiments of the invention are further disclosed in accordance with the disclosure.

The inventive conductor line is characterized in that the second contact opening of the second conductor lane is realized such that the first sliding contact to be connected to the first conductor lane cannot engage into the second contact opening and therefore cannot be connected to the second conductor lane. The inventive collector is characterized in that the first sliding contact is realized such that it cannot engage into other contact openings of other conductor lanes of the conductor line and therefore cannot be connected to the other conductor lanes.

In the inventive conductor-line system, the first sliding contact for engaging into the first contact opening and for producing the electrical connection with the first conductor lane is adapted to the first contact opening and the second contact opening of the second conductor lane is realized such that the first sliding contact cannot engage into the second contact opening and therefore cannot be connected to the second conductor lane.

Consequently, the invention makes it possible to easily and reliably prevent the first sliding contact from being accidentally or intentionally clipped into the second or other contact openings of second or other conductor lanes.

In one advantageous refinement of the conductor line, contact openings of other elongated conductor lanes may also be realized such that the first sliding contact cannot engage into the other contact openings and therefore cannot be connected to the other conductor lanes. This makes it possible to easily and reliably prevent the first sliding contact from being accidentally or intentionally clipped into the second or other contact openings of second or other conductor lanes.

The utilization of the invention is particularly advantageous if the first conductor lane is a protective conductor and the second or other conductor lanes are phase conductors.

In embodiments of the invention that are advantageous with respect to the manufacturing and installation technology, the second or additional contact openings may be narrower than the first contact opening or a first region of the first sliding contact that engages into the first contact opening is realized wider than the width of the additional contact openings.

In one embodiment of the conductor-line system, a first movable device may feature a collector with at least two sliding contacts that engage into the first and the second contact openings, respectively, in order to produce a connection with the first and the second conductor lanes of the conductor line, wherein the first conductor lane is a protective conductor. Consequently, it can be ensured that a sliding contact provided for producing a connection with the protective conductor cannot be connected to the current-carrying or energized conductor lanes of the conductor line. The invention may also be provided on a second movable device that does not feature an electric load and is coupled to the first movable device. The collector of the second movable device only features a first sliding contact that is realized such that it can engage into the first contact opening in order to produce an electric connection with the first conductor lane, but not into the second or other contact openings of the second conductor lane or the other conductor lanes.

BRIEF DESCRIPTION OF THE DRAWINGS

Embodiments of the invention are described below with reference to the accompanying drawings. In these drawings.

DETAILED DESCRIPTION OF THE INVENTION

Figure 1:
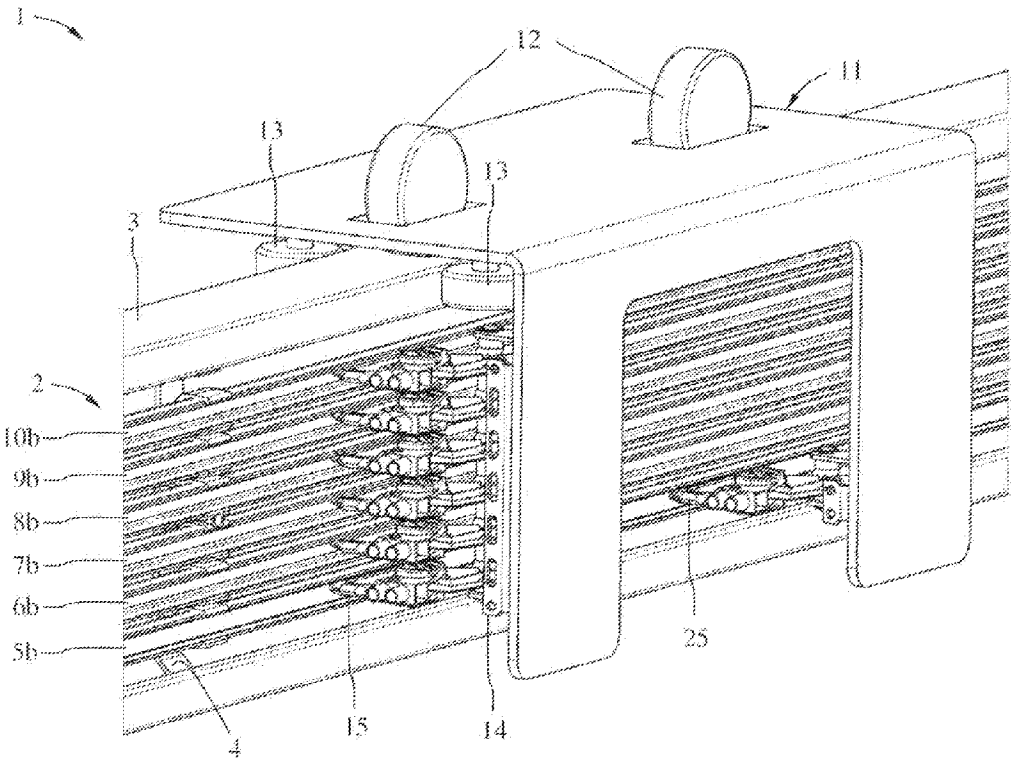
FIG. 1 shows a schematic, three-dimensional view of part of a conductor-line system with a transport gear and a conductor line.
Figure 2:
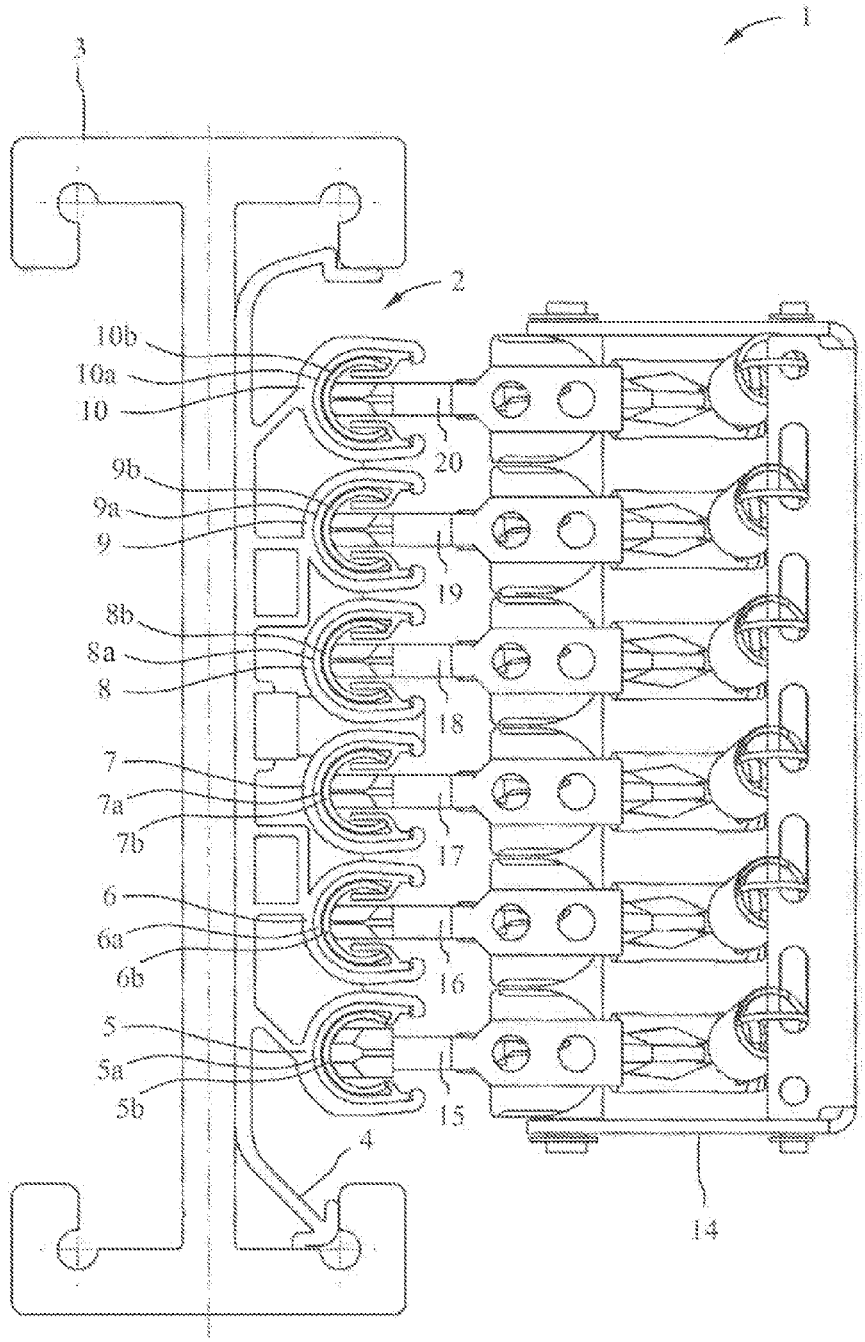
FIG. 2 shows a cross section through a conductor line and a schematic top view of a collector of the conductor-line system according to FIG. 1 that is connected to this conductor line.

The conductor-line system 1 illustrated with a cutout view in FIG. 1 features an elongated conductor line 2 and a rail track 3 that, according to the cross section and FIG. 2, has a double-T-shaped cross section. A conductor-lane holder 4 is arranged on the right side of the rail track 3 in the drawings. Other corresponding conductor-lane holders are arranged along the rail track 3, but not graphically illustrated in the drawings.

Figure 3:
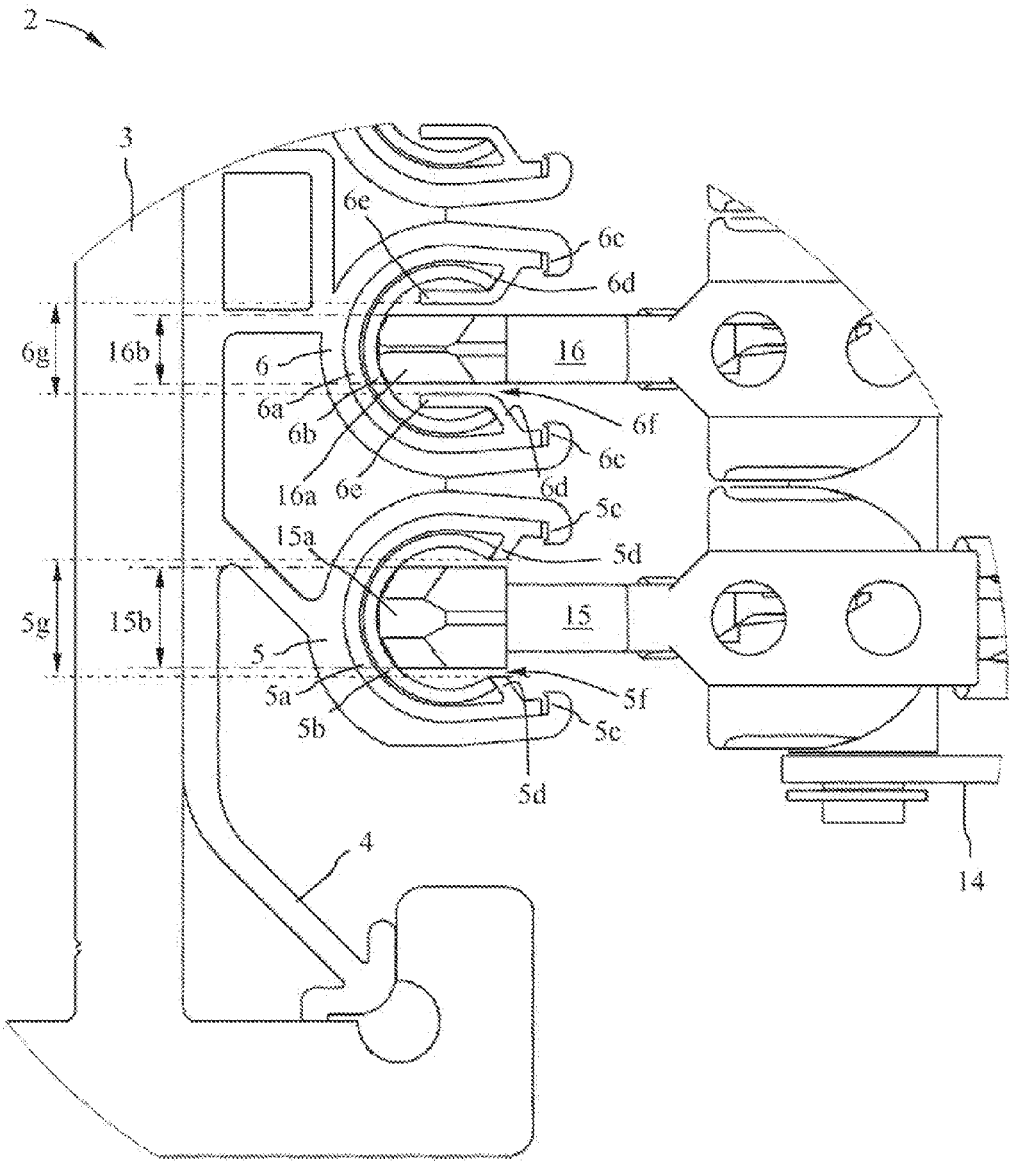
FIG. 3 shows a detail of FIG. 2.

The conductor-lane holder 4 features a total of six conductor-lane receptacles 5-10 that respectively have an essentially U-shaped cross section, wherein the open end of the U-shaped cross section points toward the right in FIG. 3. The conductor-lane holder 4 may be manufactured of plastic or metal. It would also be possible to provide a larger or smaller number of conductor-lane receptacles than the six conductor-lane receptacles 5-10 shown.

Elongated insulating profiles 5*a*-10*a* that each extend over the entire length of the conductor line 2 and consist of an electrically non-conductive material such as, for example, plastic are inserted into the conductor-lane receptacles 5-10. The insulating profiles 5*a*-10*a* also have an essentially U-shaped cross section that is directed toward the right and away from the rail track 3 in the drawings such that the open sides of the U-shaped cross sections of the conductor-lane receptacles 5-10 and of the insulating profiles 5*a*-10*a* point in the same direction.

Conductor lanes 5*b*-10*b* of electrically conductive material and an essentially C-shaped cross section are inserted into the insulating profiles 5*a*-10*a*, wherein the open side of the C-shaped cross section is directed toward the right and away from the rail track 3 in the drawings. Consequently, the open sides of the C-shaped cross sections of the conductor lanes 5*b*-10*b* and the open sides of the U-shaped cross sections of the conductor-lane receptacles 5-10 and of the insulating profiles 5*a*-10*a* point in the same direction. In this case, the insulating profiles 6*a*-10*a* extend over the entire length of the conductor lanes 5*b*-10*b*.

A first conductor lane 5*b* is realized in the form of a protective-conductor lane, wherein this first conductor lane is grounded and therefore not energized in the normal operating mode. A conductor lane 6*b* arranged directly adjacent to the first conductor lane 5*b*, as well as the following conductor lanes 7*b*-10*b*, are realized in the form of current-carrying or voltage-carrying phase-conductor lanes and serve for supplying a movable device indicated in the form of a transport gear 11 in FIG. 1 with electric energy.

The transport gear 11 features an electric motor for driving wheels 12 that is not illustrated in FIG. 1. The driving wheels 12 run on the horizontal upper section of the upper T-segment of the rail track 3. The transport gear 11 is laterally guided by lateral guide wheels 13. A collector 14 is provided in order to supply electric loads on the transport gear 11.

The collector 14 features a total of 6 sliding contacts 15-20 that can be transferred from a not-shown idle position into the engaged position illustrated in the drawings in order to produce an electrically conductive connection with the conductor lanes 5*b*-10*b*. The actual electric contact is produced by means of collector brushes that form first 15*a*, second 16*a* and other 17*a*-20*a* regions of the sliding contacts 15-20 and slide along the conductor lanes 5*b*-10*b*.

Since the other conductor-lane receptacles 6-10, insulating profiles 6*a*-10*a* and conductor lanes 6*b*-10*b* are realized identically, the invention is described below with reference to the first conductor lane 5*b* and the second conductor lane 6*b* that are illustrated in detail in FIG. 3.

The first and the second conductor-lane receptacle 5 and 6 are integrally formed from the conductor-lane holder 4 of plastic. First and second holding tabs 5*c* and 6*c* that point toward one another are provided on the front free ends of the limbs of the U-shaped cross section of the conductor-lane receptacles 5 and 6 and contacted by the front free ends of the limbs of the U-shaped cross section of the first and the second insulating profiles 5*a* and 6*a*, respectively. Consequently, it is not readily possible to unintentionally pull the first or second insulating profile 5*a* or 6*a* out of the first or the second conductor-lane receptacle 5 or 6.

The first insulating profile 5*a* for the first conductor lane 5*b* that serves as a protective conductor, as well as the second insulating profile 6*a* for the second conductor lane 6*b* that serves as a phase conductor, features holding tabs 5*d* and 6*d* on the front free ends of the limbs of its U-shaped cross section. The holding tabs 5*d* and 6*d* point toward one another and into the inner space enclosed by the limbs and are furthermore slightly directed toward the bottom of the U-shaped cross section. Consequently, the C-shaped conductor lanes 5*b* and 6*b* can be advantageously held in the insulating profiles 5*a* and 6*a*, namely due to the fact that the front free ends of the limbs of the C-shaped conductor lanes 5*b* and 6*b* contact the lower surfaces of the holding tabs 6*d* and 6*d* that are situated on the left in FIG. 3. In addition, the inwardly and downwardly angled shape of the holding tabs 5*d* and 6*d* makes it possible to easily and quickly insert the conductor lanes 5*b* and 6*b* into the insulating profiles 5*a* and 6*a* from the right side in FIG. 3, namely such that they are reliably prevented from falling out or being pulled out. This also applies, in particular, to the regions of the conductor line 2 between the conductor-lane holders 4.

The only significant difference between the first insulating profile 5*a* for the first conductor lane 5*b* (protective conductor) and the second insulating profile 6*a* for the second conductor lane (phase conductor) can be seen in that the second insulating profile 6*a* features contracting extensions 6*e* on the front ends of the second holding tabs 6*d*. The contracting extensions 6*e* are directed toward the bottom of the U-shaped cross section of the second insulating profile 6*a* and essentially extend parallel to the limbs of the U-shaped cross section of the second insulating profile 6*a*. This also applies to the other insulating profiles 7*a*-10*a* of the other conductor lanes 7*b*-10*b* (phase conductors).

Consequently, a first contact opening 5*f* that extends along the first conductor lane 5*b* and has a first width 5*g* is provided for the first conductor lane 5*b* (protective conductor), wherein a first sliding contact 15 of the collector 14 can engage into this first contact opening. According to FIG. 3, a first region 15*a* of the sliding contact 15 protrudes through the first contact opening 5*f* and past the holding tabs 5*d* in order to contact the first conductor lane 5*b* and produce an electrically conductive connection. In this case, the first region 15*a* of the first sliding contact 15 has a first width 15*b* that is dimensioned such that the first sliding contact only has a little play between the holding tabs 5*d*.

A second contact opening 6*f* extending along the second conductor lane 6*b* is provided for the second conductor lane 6*b* (phase conductor), wherein this second contact opening features the contracting extensions 6*e* and therefore has a second width 6*g* that is narrower than the first width 5*g* of the first contact opening 5*f* and, in particular, narrower than the first region 15*b* of the first sliding contact 15. A second sliding contact 16 of the collector 14 can engage into the second contact opening 6*f*, wherein a second region 16*a* of this second sliding contact protrudes through the second contact opening 6*f* and past the second holding tabs 6*d* and the contracting extensions 6*e* in order to contact the second conductor lane 6*b* and produce an electrically conductive connection. In this case, the second width 16*b* of the second region 16*a* of the second sliding contact 16 is so narrow that it only has little play between the second holding tabs 6*d* and the contracting extensions 6*e*. In addition, the second width 16*b* of the second sliding contact 16 is narrower than the first width 15*b* of the first sliding contact 15. Due to the essentially parallel contracting extensions 6*e*, the second sliding contact 16 can be easily and quickly clipped into and out of the second contact opening 6*f*.

This advantageously makes it possible to prevent the first region 15*a* of the first sliding contact 15 from coming into direct contact with the second conductor lane 6*b* through the second contact opening 6*f* or the distance between the first sliding contact region 15*a* and the second conductor lane 6*b* from becoming so small that a voltage flashover occurs and a conductive connection is produced.

Figure 4:
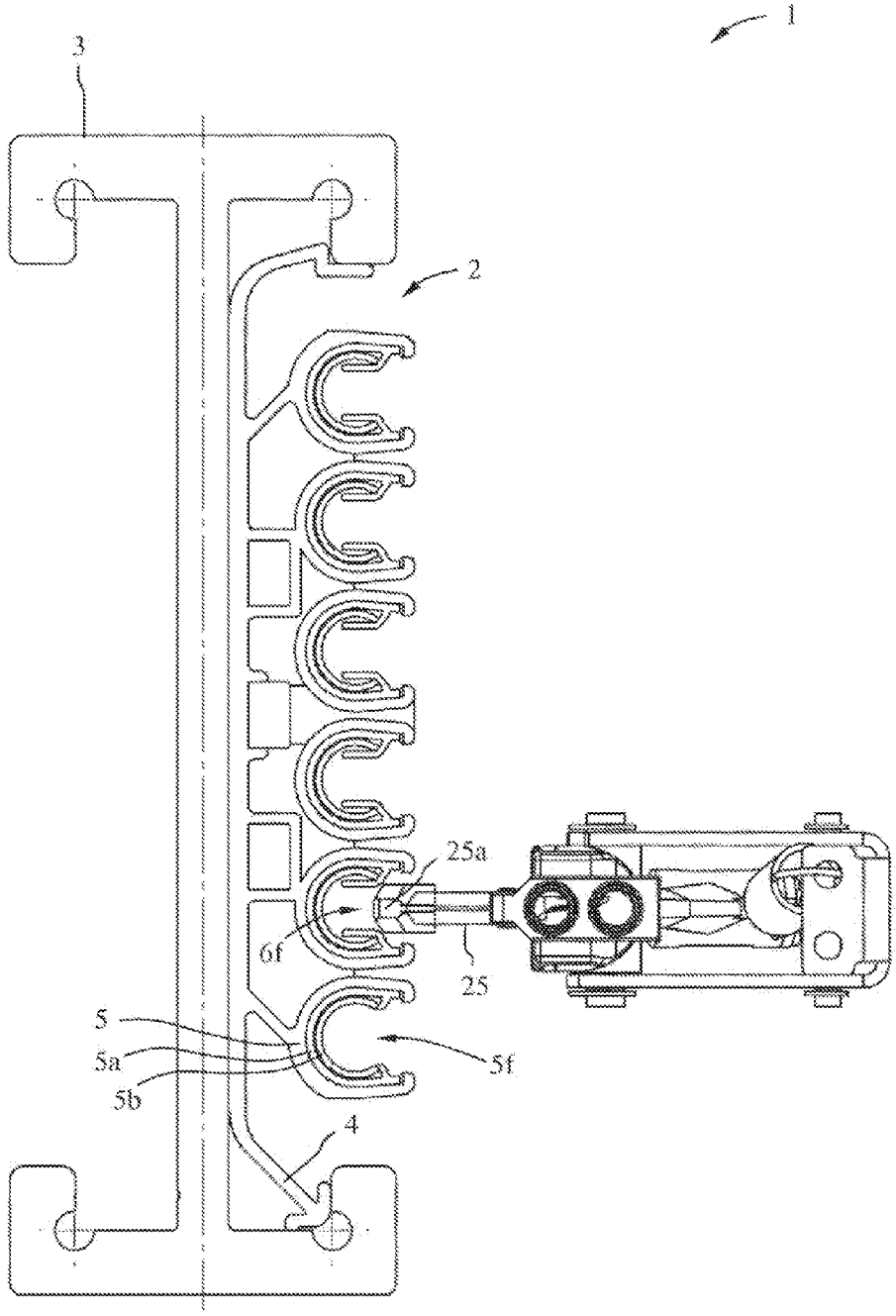
FIG. 4 shows a cross section through the conductor line according to FIG. 2 with a schematic top view of an incorrectly arranged sliding contact.

If the first sliding contact 15 is accidentally clipped into the second contact opening 6*f*, its smaller second width 6*g* reliably prevents the first collector brush 15*b* from electrically contacting the current-carrying second conductor lane 6*b* because the first collector brush 15*b* does not fit through the second contact opening 6*f* as illustrated in an exemplary fashion in FIG. 4. Even if it is not detected that the first sliding contact is incorrectly clipped in, the first collector brush 15*b* merely slides along on the second insulating profile 6*a* such that a sufficient distance from the second conductor lane 6*b* remains. It is consequently ensured that no voltage is applied to housing parts or other parts of the transport gear 11 that are not intended for carrying a current via the first protective conductor sliding contact 15.

In this case, it is advantageous that the first conductor lane 5*b* (protective conductor), as well as the other conductor lanes 6*b*-10*b* (phase conductors), can each be installed at the same distance from the contact openings 5*f*, 6*f* of the respective conductor lane 5*b*-10*b*. This makes it possible to ensure the frequently prescribed distances for preventing a voltage flashover between the conductor lanes 6*b*-10*b* and objects situated in the region of the contact openings 5*f*, 6*f* without significant design modifications. In this case, only the first region 15*a* of the protective conductor sliding contact 15 that points toward the conductor lane 5*b*, i.e., the collector brush or the sliding element itself, is replaced with a wider sliding contact with a wider first region 15*a*, i.e., a wider collector brush or sliding element, and the width of the first contact opening 5*f* of the protective-conductor lane 5*b* is increased. This makes it possible to continue using existing collectors in an unmodified fashion such that the sliding contacts 15-20 are still adequately guided in the individual conductor lanes 5*b*-10*b* in the normal operating mode, in which no sliding contacts are incorrectly inserted.

In order to additionally improve the safety, the transport gear 11 according to FIG. 1 features another sliding contact 25 for the protective-conductor lane 5*b*, adjacent to which no additional sliding contacts for the phase-conductor lanes 6*b*-10*b* are arranged. In this case, in particular, it is very easy to clip the sliding contact 25 into the adjacently positioned phase-conductor lane 6*b*. This is illustrated in an exemplary fashion in FIG. 4. According to this figure, the greater width of the collector brush 25*b* of the sliding contact 25 makes it possible to electrically connect this collector brush to the current-carrying and voltage-carrying conductor lane 6*b*.

Trailing transport gears that do not carry any electrical loads are usually also connected to the protective-conductor lane via a protective sliding contact. The invention can also be advantageously utilized for preventing an incorrect connection on these trailing transport gears by realizing the protective sliding contact analogous to the first sliding contact 15 in the above-described embodiment, i.e., they are too wide to be inserted into the second or other contact openings 6*f*, 7*f*-10*f* and to produce an electrically conductive connection with the corresponding conductor lanes 6*b*-10*b*. In this case, the preceding explanations apply accordingly.

Instead of the U-shaped cross section for the conductor-lane receptacles 5-10 and the insulating profiles 5*a*-10*a* and the C-shaped cross sections for the conductor lanes 5*b*-10*b*, it would also be possible to choose other suitable cross sections that make it possible to realize contact openings 5*f*-10*f* for the sliding contacts 15-20.

The invention claimed is:

1. Conductor line (2) for supplying at least one device (11) that can be moved along the conductor line (2), with a first elongated conductor lane (5*b*) and at least another second elongated conductor lane (6*b*), wherein the first (5*b*) and the second (6*b*) conductor lanes feature first (5*f*) and second (6*f*) contact openings, respectively, extending along the longitudinal direction of the respective lanes and serving for accommodating parts (15*a*; 16*a*) of first (15) and second (16) sliding contacts, respectively, of a collector (14) of the device (11), wherein the second contact opening (6*f*) of the second conductor lane (6*b*) is realized such that the first sliding contact (15) to be connected to the first conductor lane (5*b*) cannot engage into the second contact opening (6*f*) and therefore cannot be connected to the second conductor lane (9).

2. Conductor line (2) according to claim 1, wherein the contact openings (7*f*-10*f*) of other elongated conductor lanes (7*b*-10*b*) are realized such that the first sliding contact (15) cannot engage into the other contact openings (7*f*-10*f*) and therefore cannot be connected to the other conductor lanes (7*b*-10*b*).

3. Conductor line (2) according to claim 1 wherein the first conductor lane (5*b*) is a protective conductor and the second (6*b*) or other (7*b*-10*b*) conductor lanes are phase conductors.

4. Conductor line (2) according to claim 1, wherein the second (6*f*) or other (7*f*-10*f*) contact openings have a width (6*g*) that is narrower than the width (5*g*) of the first contact opening (5*f*).

5. Conductor line (2) according to claim 1, wherein the conductor lanes (5*b*-10*b*) have a C-shaped cross section.

6. Conductor line (2) according to claim 1, wherein the conductor lanes (5*b*-10*b*) are each inserted into elongated insulating profiles (5*a*-10*a*) of essentially U-shaped cross section, wherein holding tabs (5*d*-10*d*) that point toward one another are provided on the front ends of the limbs of the U-shaped cross section of the insulating profiles (5*a*-10*a*) in order to hold the conductor lanes (5*b*-10*b*) in the insulating profiles (5*a*-10*a*) and the contact openings (5*f*-10*f*) point toward the open side of the U-shaped cross section of the insulating profiles (5*a*-10*a*), and wherein the width (5*g*) of the first contact opening (5*f*) is defined by the distance between the holding tabs (5*c*) that point toward one another.

7. Conductor line (2) according to claim 6, wherein contracting extensions (6*d*-10*d*) are arranged on the front ends of the holding tabs (6*c*-10*c*) of the second (6*a*) or other (7*a*-10*a*) insulating profiles and directed toward the bottom of the U-shaped cross section, wherein said contracting extensions define the width (6*g*-10*g*) of the second (6*f*) and other (7*f*-10*f*) contact openings.

8. Conductor line (2) according to claim 6 wherein conductor receptacles (5-10) of essentially U-shaped cross section are provided in order to hold the insulating profiles (5*a*-10*a*) therein, wherein the contact openings (5*f*-10*f*) each point toward the open side of the U-shaped cross section.

9. Conductor line (2) according to claim 8, wherein holding tabs (5*c*-10*c*) for holding the insulating profiles (5*a*-10*a*) in the conductor receptacles (5-10) are arranged on the front ends of the limbs of the U-shaped cross section of the conductor receptacles (5-10) such that they point toward one another.

10. Collector (3) for a device (11) that can be moved along a multi-lane conductor line (2), with at least a first sliding contact (15) for engaging into a first contact opening (5*f*) that extends along the length of a first conductor lane (5*b*) of the conductor line (2) in order to produce an electric connection with the first conductor lane (5*b*), wherein the first sliding contact (15) is realized in such a way that it cannot engage into other contact openings (6*f*-10*f*) of other conductor lanes (6*b*-10*b*) of the conductor line (2) and therefore cannot be connected to the other conductor lanes (6*b*-10*b*).

11. Collector according to claim 10, wherein a first region (15*a*) of the first sliding contact (15) for engaging into the first contact opening (5*f*) has a width (15*b*) that is wider than the width (6*g*) of the other contact openings (6*f*-10*f*).

12. Collector according to claim 11, wherein the regions (16*a*-20*a*) of other sliding contacts (16-20) for engaging into the other contact openings (6*f*-10*f*) have a width (16*g*) that is narrower than the width (15*b*) of the first region (15*a*) of the first sliding contact (15).

13. Collector according to claim 11 wherein the regions (15*a*-20*a*) of the sliding contacts (15-20) are formed by collector brushes.

14. Conductor-line system (1) with one or more devices (11) that can be moved along a conductor line (2) and at least one of which features a collector (14), wherein the conductor line (2) features a first elongated conductor lane (5*b*) and at least another second elongated conductor lane (6*b*), and wherein the first (5*b*) and the second (6*b*) conductor lanes feature first (5*f*) and second (6*f*) contact openings, respectively, extending along the longitudinal direction of the respective lanes and serving for accommodating parts (15*a*; 16*a*) of first (15) and second (16) sliding contacts, respectively, of the collector (14), wherein the first sliding contact (15) for engaging into the first contact opening (5*f*) and for producing the electrical connection with the first conductor lane (5*b*) is adapted to the first contact opening (5*f*) and the second contact opening (6*f*) of the second conductor lane (6*b*) is realized such that the first sliding contact (15) cannot engage into the second contact opening (6*f*) and therefore cannot be connected to the second conductor lane (9).

15. Conductor-line system according to claim 14, wherein the conductor line (2) is realized in accordance with one of claims 1-9 and/or the collector (14) is realized in accordance with one of claims 10-13.

16. Conductor-line system according to claim 14 wherein other contact openings (7*f*-10*f*) of other conductor lanes (7-10) of the conductor line (2) are realized in such a way that the first sliding contact (15) cannot engage therein and therefore cannot be connected to the other conductor lanes (7*b*-10*b*).

17. Conductor-line system according to claim 14, wherein a first movable device (11) features a collector (14) with at least two sliding contacts (14, 15) that engage into the first (5*f*) and second (6*f*) contact openings, respectively, in order to produce a connection with the first (5*b*) and the second (6*b*) conductor lanes, respectively, of the conductor line (2), wherein the first conductor lane (5*f*) is a protective conductor.

18. Conductor-line system according to claim 17, wherein the first movable device is coupled to a second movable device, the collector of which only features a first sliding contact that is realized such that it can engage into the first contact opening (5*f*) in order to produce an electric connection with the first conductor lane (5*b*), but not into the second (6*f*) or other (7*f*-10*f*) contact openings of the second conductor lane (6*b*) or other conductor lanes (7*f*-10*f*).

19. Conductor-line system (1) according to claim 14, wherein the second (6*f*) contact opening has a width (6*g*) that is narrower than the width (5*g*) of the first contact opening (5*f*).

20. Conductor line-system (1) according to claim 18, wherein the second (6*f*) or other (7*f*-10*f*) contact openings have a width (6*g*) that is narrower than the width (5*g*) of the first contact opening (5*f*).

* * * * *

UNITED STATES PATENT AND TRADEMARK OFFICE

CERTIFICATE OF CORRECTION

PATENT NO. : 8,419,450 B2
APPLICATION NO. : 13/061990
DATED : April 16, 2013
INVENTOR(S) : Schmiedle et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 165 days.

Signed and Sealed this
First Day of September, 2015

Michelle K. Lee

Michelle K. Lee
*Director of the United States Patent and Trademark Office*